US010077942B2

(12) United States Patent
Hartung et al.

(10) Patent No.: US 10,077,942 B2
(45) Date of Patent: Sep. 18, 2018

(54) DEVICE AND METHOD FOR CONTROLLING AND/OR REGULATING AN ANNEALING OR HEAT TREATMENT FURNACE OF A PRODUCTION LINE PROCESSING METAL MATERIAL

(71) Applicant: SMS Group GmbH, Duesseldorf (DE)

(72) Inventors: Hans-Georg Hartung, Pulheim (DE); Ulrich Sommers, Duesseldorf (DE); Matthias Baerwald, Freudenberg (DE); Alexandre Lhoest, Eupen (BE)

(73) Assignee: SMS Group GmbH, Duesseldorf (DE)

( * ) Notice: Subject to any disclaimer, the term of this patent is extended or adjusted under 35 U.S.C. 154(b) by 0 days.

(21) Appl. No.: 14/893,218

(22) PCT Filed: May 22, 2014

(86) PCT No.: PCT/EP2014/060505

§ 371 (c)(1),
(2) Date: Nov. 23, 2015

(87) PCT Pub. No.: WO2014/187886

PCT Pub. Date: Nov. 27, 2014

(65) Prior Publication Data

US 2016/0102916 A1 Apr. 14, 2016

(30) Foreign Application Priority Data

May 22, 2013 (DE) ..... 10 2013 209 410
Dec. 11, 2013 (DE) ..... 10 2013 225 579

(51) Int. Cl.

| | |
|---|---|
| ***F27D 19/00*** | (2006.01) |
| ***C21D 9/56*** | (2006.01) |
| ***F27D 21/00*** | (2006.01) |

(52) U.S. Cl.
CPC ..... *F27D 19/00* (2013.01); *C21D 9/56* (2013.01); *F27D 21/00* (2013.01); *F27D 2019/0003* (2013.01); *F27D 2019/0028* (2013.01)

(58) Field of Classification Search
CPC ..... C21D 9/0006; C21D 11/00
(Continued)

(56) References Cited

U.S. PATENT DOCUMENTS

| | | | |
|---|---|---|---|
| 6,180,933 | B1 | 1/2001 | Demidovitch |
| 7,251,971 | B2 | 8/2007 | Reinschke |

(Continued)

FOREIGN PATENT DOCUMENTS

| | | |
|---|---|---|
| CN | 201163217 | 12/2008 |
| EP | 2287345 | 2/2011 |

(Continued)

*Primary Examiner* — Scott R Kastler
(74) *Attorney, Agent, or Firm* — Abelman, Frayne & Schwab

(57) ABSTRACT

The invention relates to a device for controlling and/or regulating an annealing or heat treatment furnace (2) of a production line (1) processing metal material, which comprises the annealing or heat treatment furnace (2) and at least one measuring instrument (7, 8, 17), which detects at least one material property of a strip material (6) located in the production line (1), wherein the annealing or heat treatment furnace (2) and the at least one measuring instrument (7, 8) interact in a regulating and/or control circuit of an automated process control, which regulates and/or controls the annealing or heat treatment furnace (2) in connection with a furnace control, wherein according to the invention, a solution is created wherein an improvement of the process control over the previously known prior art can be achieved. This is achieved in that the at least one measuring instrument (7, 8) is arranged behind the annealing or heat treatment furnace (2) in the strap material processing direction (5) and
(Continued)

detects online a measured value reproducing and/or depicting a mechanical material property of the strap material (6) and transmits said measured value to a regulating and/or control unit (18) as a data transfer signal.

9 Claims, 5 Drawing Sheets

(58) Field of Classification Search
USPC ..... 148/508
See application file for complete search history.

(56) References Cited

U.S. PATENT DOCUMENTS

| | | | | |
|---|---|---|---|---|
| 7,310,981 | B2 | 12/2007 | Matthias | |
| 7,617,609 | B2 | 11/2009 | Sano | |
| 7,617,709 | B2 * | 11/2009 | Sano | B21B 37/44 72/14.8 |
| 8,296,081 | B2 | 10/2012 | Goto | |
| 2004/0164171 | A1 | 8/2004 | Yijima | |
| 2006/0117549 | A1 | 6/2006 | Plociennik | |
| 2007/0151635 | A1 | 7/2007 | Sano | |
| 2010/0001827 | A1 | 1/2010 | Sano | |
| 2010/0018270 | A1 | 1/2010 | Sano | |
| 2010/0219567 | A1 | 9/2010 | Imanary | |
| 2014/0175713 | A1 | 8/2014 | Roessiger | |

FOREIGN PATENT DOCUMENTS

| | | |
|---|---|---|
| GB | 1468178 | 3/1977 |
| JP | 583926 | 1/1983 |
| JP | 59110737 | 6/1984 |
| JP | 01219127 | 9/1989 |
| JP | 04236724 | 8/1992 |
| JP | 05171258 | 7/1993 |
| JP | 0762447 | 3/1995 |
| JP | 09118927 | 5/1997 |
| JP | 10130742 | 5/1998 |
| JP | 11153581 | 6/1999 |
| JP | 2003147440 | 5/2003 |
| JP | 2008013839 | 1/2008 |
| JP | 2008115426 | 5/2008 |
| RU | 2068006 | 2/1997 |
| RU | 2299916 | 5/2007 |
| WO | 2008090597 | 7/2008 |

* cited by examiner

DEVICE AND METHOD FOR CONTROLLING AND/OR REGULATING AN ANNEALING OR HEAT TREATMENT FURNACE OF A PRODUCTION LINE PROCESSING METAL MATERIAL

CROSS REFERENCE TO RELATED APPLICATIONS

This application is a national phase of PCT application No. PCT/EP2014/0060505, filed May 22, 2014, which claims priority to DE patent application No. 102013209410.8, filed May 22, 2013 and to DE patent application No. 102013225579.9, filed Dec. 11, 2013, all of which are incorporated herein by reference thereto.

BACKGROUND OF THE INVENTION

1. Field of the Invention

The invention relates to a device for controlling and/or regulating an annealing or heat treatment furnace of a production line processing metal material, which comprises the annealing or heat treatment furnace and at least one measuring instrument, which detects at least one material property of a strap material located in the production line, wherein the annealing or heat treatment furnace and the at least one measuring instrument interact in a regulating and/or control circuit of an automated process control, which regulates and/or controls the annealing or heat treatment furnace in connection with a furnace control.

The invention further relates to a method for controlling and/or regulating an annealing or heat treatment furnace of a production line processing metal material comprising the annealing or heat treatment furnace, preferentially at least one rolling and/or stretching station arranged behind the former in the strap material processing direction, as well as at least one measuring instrument which detects at least one material property of a strap material located in the production line, wherein the annealing or heat treatment furnace, preferentially the at least one rolling and/or stretching station arranged behind the former in the strap material processing direction, and the at least one measuring instrument interact in a regulating and/or control circuit of an automated process control, with which the annealing or heat treatment furnace is controlled and/or regulated in connection with a furnace control.

2. Description of the Prior Art

In the framework of processing strap materials made out of a ferrous material or a non-ferrous metal, it is common that, for instance before performing one or multiple rolling step(s), the strap material is heated for it to be more processable in the subsequent deep-drawing process. For instance, in an annealing treatment, strap materials are fed into an annealing furnace and exposed to a temperature of 700 to 900° C. in order to pre-process straps that might, for example, have previously been cold-rolled, so as to make them more processable in the subsequent deep-drawing process and possibly in a coating process.

Due to the ever increasing requirements of the industry from its suppliers, and of the automotive industry in particular, it is increasingly important to generate and document material with homogeneous properties within narrow tolerance ranges. In order to realize this, an automated process control is an imperative condition.

Such a device and such a method for controlling a process line are known from U.S. 2010/0219567 A1 and from EP 2 557 183 A1. The process line known from these are a CAL (Continuous Annealing Line) or a CGL (Continuous Galvanized Line) process line. It is also already provided there that the respective annealing furnace is controlled by means of a measuring instrument which detects a measured value reproducing and/or depicting mechanical material properties of the strap material. However, it is provided there that the furnace parameters are regulated directly.

A disadvantageous aspect of this prior art is that the annealing furnace is thermally inert, and that the conditions in the furnace do not change rapidly. A standard regulation concept is therefore unsuccessful.

The object of the present invention is to provide improved, in comparison with known prior art, device and method for controlling and/or regulating an annealing or heat treatment furnace of a production line for processing metal material.

SUMMARY OF THE INVENTION

In a device of the type detailed above, the problem is solved according to the invention in that the at least one measuring instrument is arranged behind the annealing or heat treatment furnace in the strap material processing direction detects online a measured value reproducing and/or depicting mechanical material properties of the strap material, and transmits this measured value, specifically as a data transfer signal, to a regulating and/or control unit.

Based on previous furnace behavior, this regulation and/or control unit learns the reaction of the furnace to different furnace conditions, and adjusts it in order to adjust the measured values for incoming straps. This reduces the scattering of the measured values. For this learning process, information on processes ahead of the annealing furnace (whether measured values or positioning values) may also be used.

Similarly, the aforementioned problem is solved in a generic process in that with the at least one measuring instrument, a measured value reproducing and/or depicting mechanical material properties of the strap material is detected online, which measured value is then transmitted, specifically as a data transfer signal, to a regulating and/or control unit.

Based on previous furnace behavior, this regulation and/or control unit learns the reaction of the furnace to different furnace conditions, and adjusts it in order to adjust the measured values for incoming strap material. This reduces the scattering of the measured values. For this learning process, information on processes ahead of the annealing furnace (whether measured values or actual values) may also be used.

The specific data transfer signal may be an electrical signal, an electronic signal, a signal in the form of an electromagnetic wave, a radio signal, a light signal, or an infrared signal, which is suitable for transmitting measured values or information.

The achievement of the invention is that the entire length of a heat-treated or annealed strap material is captured at the exit from the furnace or behind the annealing or heat treatment furnace in the strap material processing direction. By way of this preferentially continuously executed monitoring of the mechanical properties of the annealed or heat-treated strap material, the settings of the furnace can be set in such a manner that the mechanical properties for subsequent strap material are within the desired value range, meaning that their variance or scattering is within the tolerable margins. Since the mechanical properties are permanently and continuously monitored during the implementation of a process, the actual marginal values of the mechanical properties can also be used as marginal values of the control and/or measurement system. The process range is the range (from a minimum value up to a maximum value) for a furnace parameter (furnace zone temperature, strip target temperature, or strip moving speed) which, if observed in the production procedure, brings about the production of the required mechanical properties of the strip. The annealment cycles can be adapted, and the process ranges can be changed. In the best case it is no longer necessary to restrict [the process] to predefined parameters such as an annealment cycle and to its associated marginal values. The scattering of the mechanical properties over the entire annealment process is therefore optimized and better adapted to the desired parameters and marginal conditions. Furthermore, this makes it possible to approach closer to the limits of, for example, the annealment temperature necessary or adapted in order to obtain the desired mechanical properties, and therefore design the process in a more environmental and economical way, and in particular, to be able to increase its productivity. Moreover, the type of measurement according to the invention makes it possible to perform transitions between strap materials of different quality and to adjust them to each other, since the respective selected mechanical property of the respective strap material can be present as a relevant value, which allows for controlling the overlap of the successive straps.

Moreover, the measuring instrument or the measuring instruments of the device according to the invention or of the method according to the invention can be used for a specific period in order to determine the best process range for the respective material quality, for instance the respective steel quality.

In one embodiment, the invention envisions the provision of a rolling or stretching station arranged behind the annealing or heat treatment furnace, which interacts with the annealing or heat treatment furnace and the at least one measuring instrument in the regulating and/or control circuit of the automated process control.

It is furthermore possible that the at least one measuring instrument is arranged behind the rolling and/or stretching station in the strap material processing direction, which is also provided by the invention.

In one embodiment the invention further envisions that the at least one measuring instrument is arranged behind the annealing or heat treatment furnace in the strap material processing direction and ahead of the rolling and/or stretching station. The positioning of a measuring instruments behind the annealing or heat treatment furnace but ahead of the rolling and/or stretching station makes it possible to use the impact of the annealing or heat treatment on the measured mechanical property of the strap material only as the foundation for the regulation or control of the furnace operation.

There is a further advantage when the at least one measuring instrument is arranged behind the final mechanical processing device in the strap material processing direction, which is also provided by the invention. In that case, the impact of all the previous material processing or material treatment in the production line on the measured mechanical property of the strap material becomes the foundation for the regulation or control of the furnace operation and/or the mechanical processing.

Furthermore, in a further development of the invention it is envisioned that a first measuring instrument is arranged behind the annealing or heat treatment furnace in the strap material processing direction, and ahead of the rolling and/or stretching station, and that a second measuring instrument is arranged behind the rolling and/or stretching station.

Due to the fact that a second measuring instrument is arranged behind the rolling and/or stretching station in the strap material processing direction, it is possible to measure the impact by the mechanical processing stations, which may comprise one or multiple rolling station(s), one or multiple stretching station(s), skin pass mill(s) or stretcher leveler(s) on the respective measured mechanical property, and to take it into account for the control of the annealing or heat treatment furnace as well as for the control of the mechanical processing stations or devices, meaning the rolling and/or stretching station(s). The measurement with a measuring instrument arranged behind a rolling and/or stretching station in the strap material processing direction is advantageous in that it allows for the mechanical property of the strip after a deformation process to be taken into account. It is particularly advantageous in this context when the mechanical properties of the final product are taken into account for the controls in the regulating and/or control circuit, and for that reason it is envisioned that a measuring instrument is arranged behind the final mechanical processing equipment in the processing direction of the production line.

However, it is also possible to allow both measuring instruments to respectively impact measurement and regulation circuits of the regulating and/or control circuit that impact the furnace control and the mechanical processing, and the respective associated equipment and devices.

When two measuring instruments are used, however, it can also be envisioned that one measuring instrument is arranged ahead of the annealing or heat treatment furnace in the strap material processing direction, and the second measuring instrument is arranged immediately behind the annealing or heat treatment furnace, or behind the mechanical processing arranged ahead of the rolling and/or stretching station, in the strap material processing direction. The respective measured values are fed to a control or regulation unit, which uses a learning function to impact the furnace control and, depending on the case, the mechanical processing. On this, the invention envisions that a first measuring instrument is arranged behind the annealing or heat treatment furnace in the strap material processing direction, and ahead of the rolling and/or stretching station, and that an additional measuring instrument is arranged ahead of the annealing or heat treatment furnace in the strap material processing direction. Similarly, with respect to this aspect, the invention is characterized in that a (second) measuring instrument is arranged behind the rolling and/or stretching station in the strap material processing direction, and an additional measuring instrument is arranged ahead of the annealing or heat treatment furnace in the strap material processing direction.

Moreover, in an expedient embodiment, the invention is also characterized in that the first measuring instrument arranged behind the annealing or heat treatment furnace in the strap material processing direction and/or an additional measuring instrument arranged ahead of the annealing or heat treatment furnace in the strap material processing direction impact(s) the furnace control through the provision of feedback.

In this embodiment, the invention further envisions that the specifically second measuring instrument arranged behind the at least one rolling and/or stretching station or from a rolling and/or stretching station in the strap material processing direction, and/or the first or an additional measuring instrument arranged ahead of or immediately behind the annealing or heat treatment furnace in the strap material processing direction, impacts the furnace control and the control of the at least one or of an associated rolling and/or stretching station through the provision of feedback.

A particularly expedient measurement is the real-time online measurement. The invention is therefore further characterized in that the at least one measuring instrument, preferentially all measuring instruments, capture(s) the measured value reproducing and/or depicting the mechanical material properties of the strap material by way of a real-time online measurement. A particularly advantageous layout of the regulating and/or control circuit is when in the framework of a learning process, the measured value reproducing and/or depicting the mechanical material properties of the strap material is fed back into the regulating and/or control circuit, specifically into the furnace control and/or furnace regulation of the annealing or heat treatment furnace.

An annealing or heat treatment furnace can be controlled and/or regulated according to the invention in a particularly advantageous and expedient manner when the regulating and/or control circuit comprises a furnace model control displayed and/or stored in it, as provided by the invention as well. The furnace model control may comprise any type of model, departing from a simple linear model up to a thermodynamic model with learning and adaption functions. Every type of furnace model can be used for storage as a furnace model control.

Moreover, in a further embodiment of the invention, it may also be provided that the regulating and/or control circuit comprises a material model.

Expedient furnace parameters that can be controlled by means of a regulation and/or control system embodied according to the invention are, for instance, the strip target temperature in the heating and/or cooling range of the annealment and/or heat treatment furnace, the strip moving speed in the process line, the furnace temperature, or the furnace capacity of the annealment and/or heat treatment furnace, the coolant storage on the processed strap material, or the coolant type. The invention is therefore further characterized in that the one or multiple furnace parameters comprise at least one of the following values: strip target temperature in the heating and/or cooling range of the annealing or heat treatment furnace, process range of this strip target temperature, strip moving speed, process range of this strip moving speed, furnace temperature, process range of this furnace temperature, furnace temperature pattern (local and temporal distribution of furnace temperatures), furnace capacity, cooling rate, coolant impact, or coolant type.

A particularly suitable measuring instrument is a remanence measuring instrument, which is why the invention further provides that the at least one measuring instrument, and preferentially all measuring instruments, is/are a respective remanence measuring instrument, which detects a magnetic value as its measured value.

However, the measuring instrument detecting a mechanical property may also be embodied as a laser ultrasound device or as an electromagnetic ultrasound device or as an X-ray transmission device.

The device according to the invention and the method according to the invention are particularly advantageous when used for the annealing or galvanizing of steel or aluminum material. The invention is therefore also characterized in that the device is part of a continuous annealing and/or galvanizing line for a steel or aluminum material.

Similar to the device according to the invention, the method according to the invention in a further development is also characterized in that the regulating and/or control circuit impacts the furnace control and/or furnace regulation of the annealing or heat treatment furnace and/or the provisions and/or control of the rolling and/or stretching station through the provision of feedback by means of at least one measured value determined by means of a measuring instrument arranged behind the annealing or heat treatment furnace in the strap material processing direction or behind the rolling and/or stretching station, and which reflects and/or illustrates mechanical material properties of the strap material.

An additional advantage is when by way of a first measuring instrument arranged behind the annealing or heat treatment furnace in the strap material processing direction and before the or a rolling and/or stretching station, and a second measuring instrument arranged behind the rolling and/or stretching station in the strap material processing direction, and/or an additional measuring instrument arranged ahead of the annealing or heat treatment furnace in the strap material processing direction, respectively, a measured value reproducing and/or depicting mechanical material properties of the strap material is detected online and transmitted to the regulation and/or control unit, which is also provided by the invention.

Similarly, the invention is also characterized in that by way of a (second) measuring instrument arranged behind the or a rolling and/or stretching station in the strap material processing direction and a second or additional measuring instrument arranged ahead of or immediately behind the annealing or heat treatment furnace in the strap material processing direction, measured values reproducing and/or depicting the mechanical material properties of the strap material are detected online and transmitted to the regulation and/or control unit.

Also for these purposes it is expedient that the measured value reproducing and/or depicting the mechanical material properties of the strap material is detected by way of a real-time online measurement and/or is fed back in the framework of a learning process into the regulating and/or control circuit, specifically into the furnace control and/or furnace regulation of the annealing or heat treatment furnace, which is also provided by the invention.

DETAILED DESCRIPTION OF THE PREFERRED EMBODIMENTS

Figure 1:
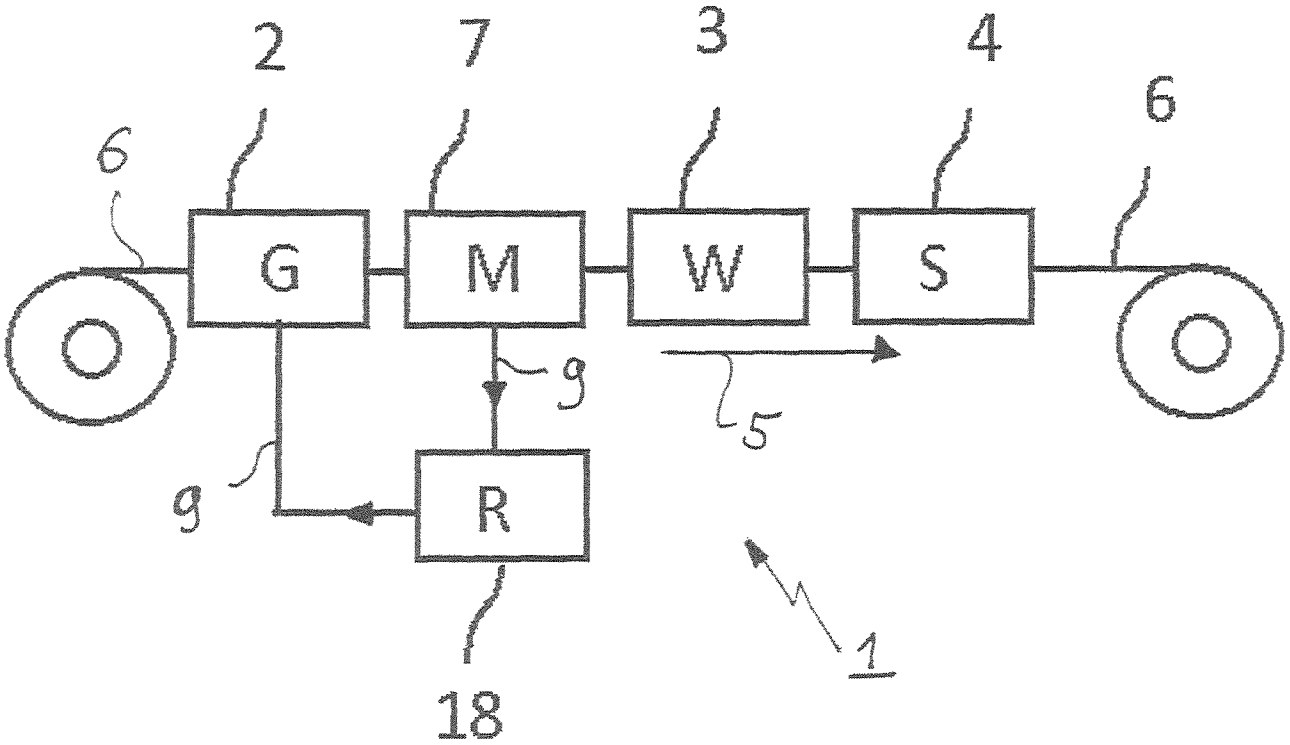
FIG. 1*a*) through FIG. 1*e*) shows schematically different embodiments of an annealing or heat treatment line according to the present invention for processing a strap material.
Figure 1:
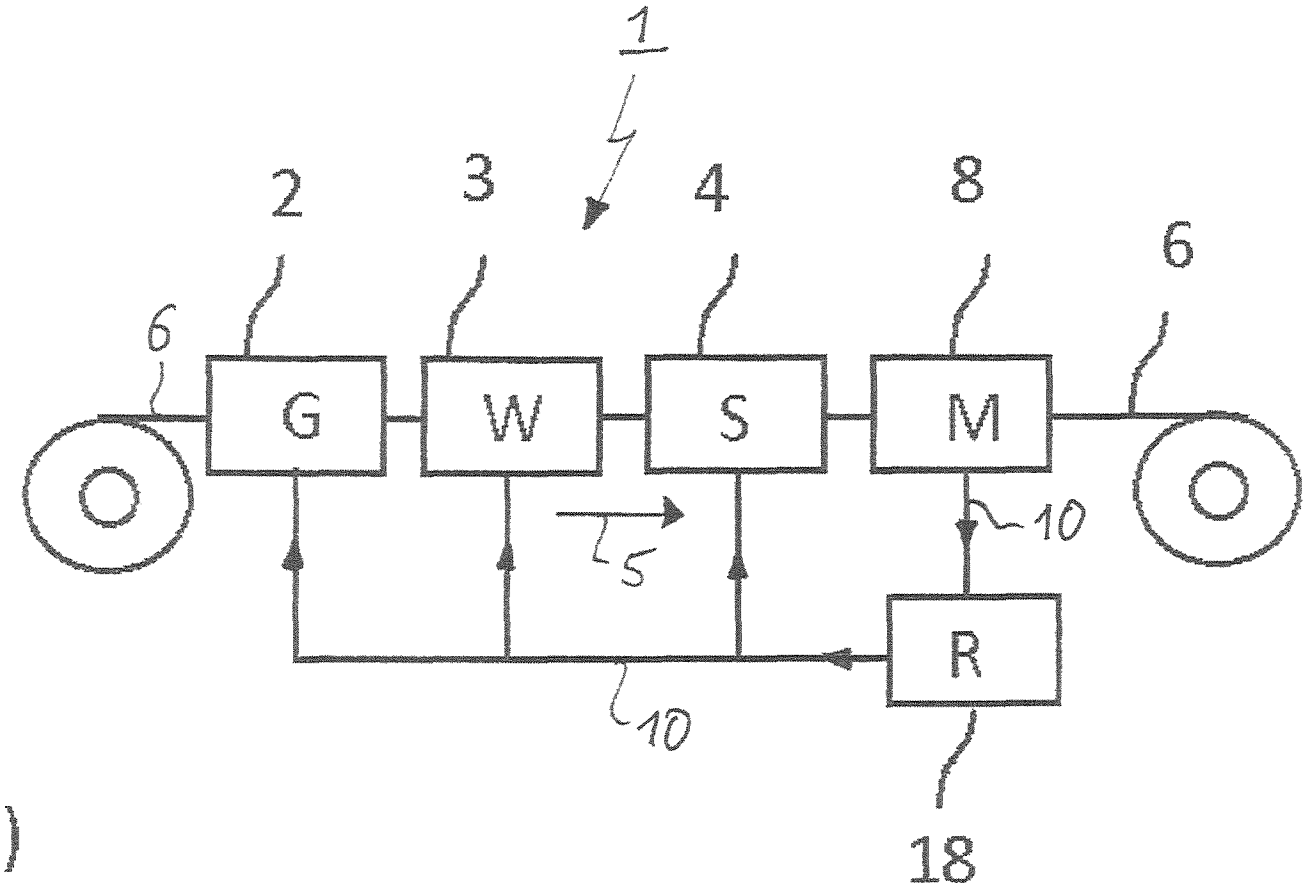
Figure 1:
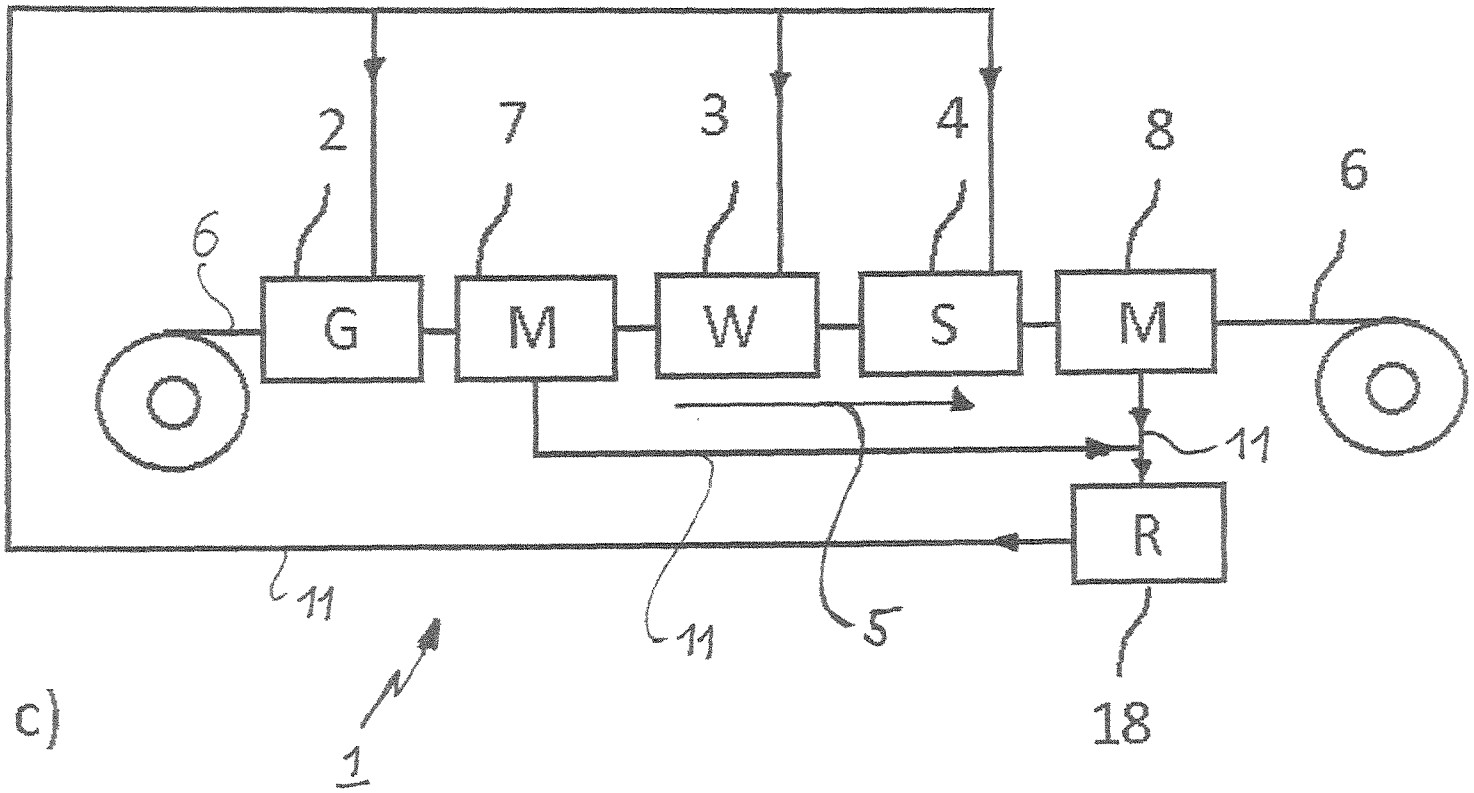
Figure 1:
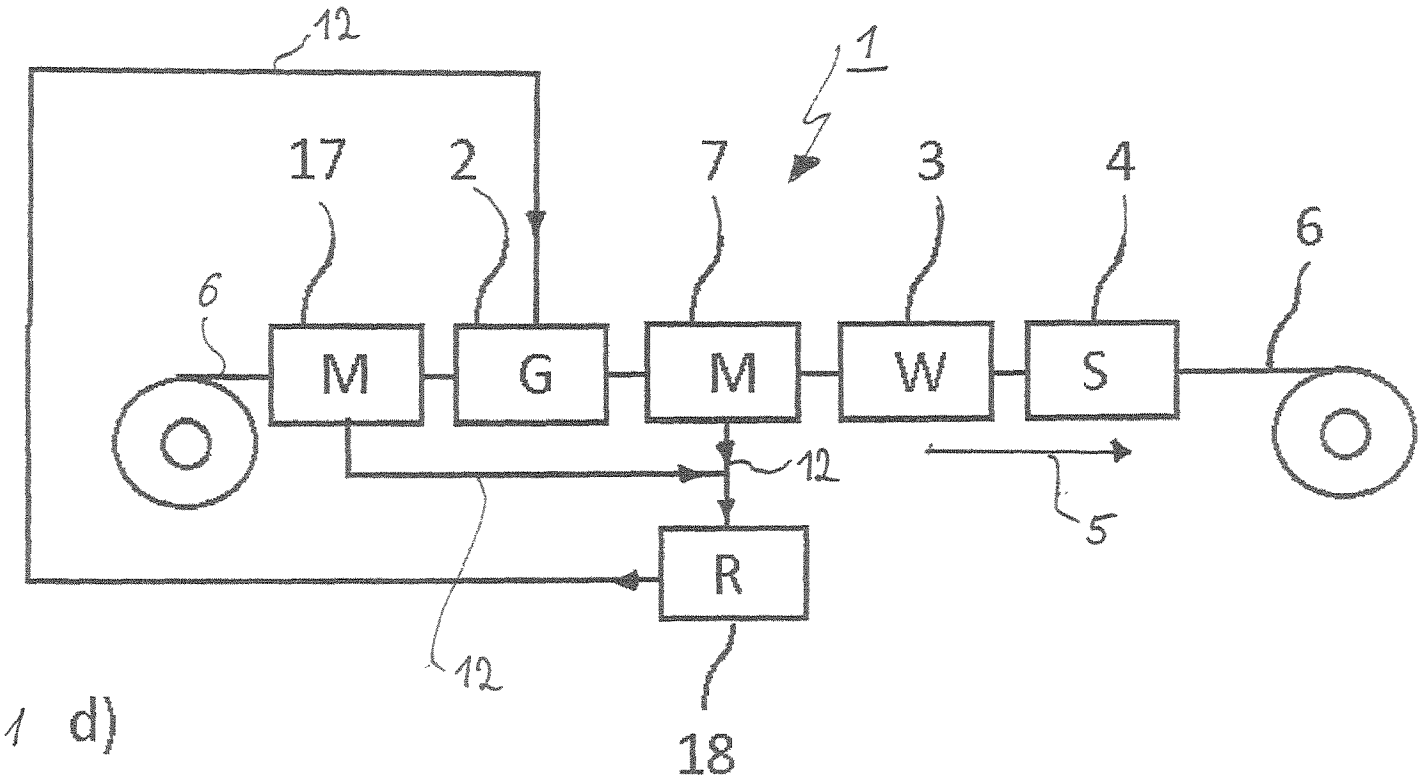
Figure 1:
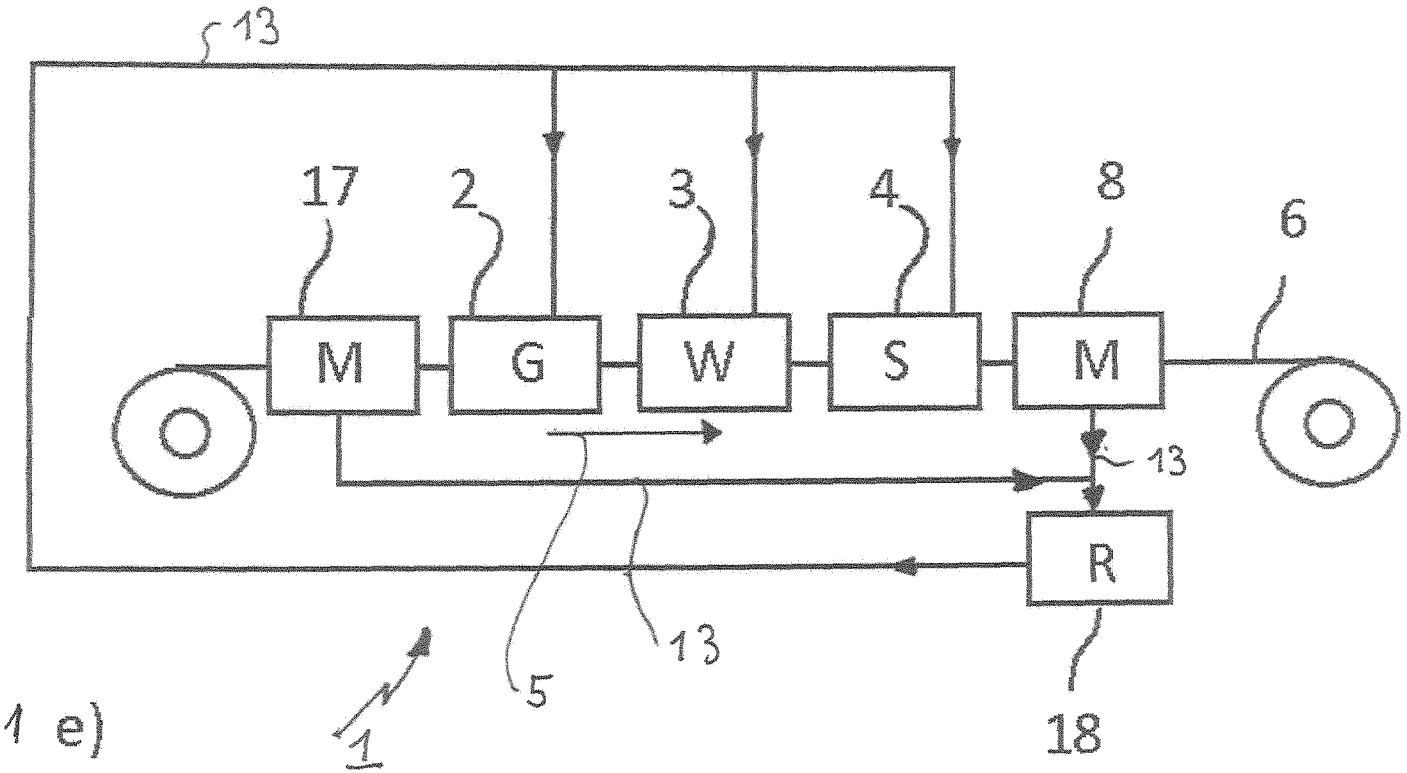

In the respective partial images *a*) through *e*), the only figure schematically shows a production line in the form of a CAL (Continuous Annealing Line), marked throughout as 1. It includes the schematically shown elements annealing or heat treatment furnace 2, a rolling station 3 arranged behind the respective annealing or heat treatment furnace 2, and embodied as a skin pass mill, as well as a stretching station 4 in the form of a stretcher leveler, arranged behind the latter in the strap material processing direction 5. In directions of the arrow 5, a strap material 6 made out of a metal material, specifically a ferrous material, preferentially steel, or of a non-ferrous metal, specifically aluminum, is moved into the annealing or heat treatment furnace 2, from there to the rolling station 3 and from there to the stretching station 4, and from there out of the production line 1. Furthermore, in the production line 1 between the annealing or heat treatment furnace 2 and the rolling station 3 in each of the embodiments according to the partial images a), c), and d), a first measuring instrument 7 is provided that detects at least one material property of the strap material 6. Specifically, the measuring instrument 7 may be a remanence measuring instrument, detecting a magnetic value as a material property of the strap material 6. Moreover, in the embodiments according to the partial images b), c), and e), a second measuring instrument 8 is arranged behind the stretching station 4 and therefore also behind the last piece of mechanical processing equipment intended for the mechanical processing of the strap material 6 of the production line 1, which also detects at least one material property of the strap material 6, preferentially the same material property as the first measuring instrument 7. In the embodiment according to the partial images d) and e), an (additional) measuring instrument 17 is arranged ahead of the annealing or heat treatment furnace 2. For either the measuring instrument 7, 8 or for the measuring instrument 17, it is possible that the mechanical material property of the metal strip 6 that is meant to be observed or to be established or to be determined is only determined indirectly. In any case, a measured value is determined by means of the respective measuring instrument 7 or 8 which reflects and/or illustrates the desired mechanical material properties of the strap material 6. In measurement and regulation circuits not shown here, or in a regulating and/or control circuit not shown here, this may be converted into an electrical or data transfer signal, and be transmitted to the regulating and/or control circuit or to individual measurement and regulation circuits interacting with it.

The regulating and/or control circuit not shown here is part of an automated process control which controls and/or regulates the annealing or heat treatment furnace 2, and under certain circumstances also the rolling station 3 and/or the stretching station 4 taxes behind it. The measured values detected by the measuring instrument 7 and/or 8 and/or 17 or electrical signals derived from them, are fed to a furnace control and/or a control of the rolling station 3 and/or the control of the stretching station 4 by way of feedback via the corresponding regulation circuits 9, 10, 11, 12, 13, which impact the regulating and/or control circuit not shown here of the automated process control or which are part of it, for the purpose of controlling the annealing or heat treatment furnace 2, as will be explained below in the context of the partial images a) through e).

The first measuring instrument 7 and the second measuring instrument 8 or the additional measuring instrument 17 determine or capture the measured value reproducing and/or depicting a mechanical material property of the strap material 6 online by way of a real-time online measurement. This respective measured value or an electrical signal derived from it is fed back into the regulating and/or control circuit of the production line 1, specifically into the furnace control and/or furnace regulation of the annealing or heat treatment furnace 2 in the framework of a closed loop process. Preferentially, this regulating and/or control circuit comprises a furnace model, displayed or stored in it in the form of a furnace model control. Furthermore, the regulating and/or control circuit may comprise a material model.

Specifically, in regard to and/or through the interaction with the furnace control and/or furnace regulation, one or multiple furnace parameters are controlled with the learning regulation and/or control unit in such a manner that a predetermined value or value range of the measured or detected mechanical material property or of the detected mechanical material properties of the strap material 6 is obtained or set. These furnace parameters can be at least one of the following values: the strap target temperature in the heating and/or cooling range of the annealing or heat treatment furnace 2, the strap moving speed, the furnace temperature, the furnace capacity, the coolant storage, meaning the manner in which the strap material 6 is stored with a coolant, or the coolant type.

Each of the measuring instruments 7, 8, and 17 may be a remanence measuring instrument detecting a magnetic value as measured value. However, the respective measuring instrument 7, 8 may also be a measuring instrument of any other type which allows the direct or indirect detection of mechanical properties of the observed strap material 6.

Preferentially, the production line 1 shown in the partial images a) through e) of the figure is a continuous annealing and/or galvanizing line for a steel or aluminum material.

In the embodiment shown in partial image a), only a measuring instrument 7 is arranged between the annealing or heat treatment furnace 2 and the rolling station 3, which feeds back into the regulating and/or control circuit, and here specifically, into the furnace control, via a regulation circuit 9.

In the exemplary embodiment according to partial image b), the second measuring instrument 8 is arranged behind the mechanical processing equipment in the processing direction 5 of the strap material 6, and therefore behind the rolling station 3 and the stretching station 4, which feeds back into the regulating and/or control circuit via the regulation circuit 10, and impacts the control of the furnace 2 as well as of the rolling station 3 and/or of the stretching station 4.

In the embodiment according to partial image c), the first measuring instrument 7 is arranged between the annealing or heat treatment furnace 2 and the rolling station 3, and the second measuring instrument 8 is arranged behind the stretching station 4 in the processing direction 5.

The regulation unit 18 receives measured values from measuring instrument 7 and 8. In the framework of the regulation circuit 11, these feed back into the annealing furnace 2 and the rolling station 3 and the stretching station 4.

In the exemplary embodiment according to partial image d), the first measuring instrument 7 is arranged between the annealing or heat treatment furnace 2 and the rolling station 3, and the additional measuring instrument 17 is arranged ahead of the annealing or heat treatment furnace 2 in terms of the direction in which the strap material is processed 5. Via a regulation circuit 12, the measured values fed by the measuring instrument 7 and 17 into the regulation unit 18 are fed back into the regulating and/or control circuit of the annealing or heat treatment furnace 2.

The exemplary embodiment according to partial image e) shows an embodiment in which the second measuring instrument 8 is arranged behind the stretching station 4 in the strap material processing direction 5, and the additional measuring instrument 17 is arranged ahead of the annealing or heat treatment furnace 2. The measured values fed into the regulation unit 18 by the second measuring instrument 8 and the additional measuring instrument 17 are fed back into the regulating and/or control circuit of the annealing or heat treatment furnace 2, of the rolling station 3, and of the stretching station 4 in the framework of a regulation circuit 13.

In a manner not shown here, the combination of the first measuring instrument 7 and the second measuring instrument 8 or the additional measuring instrument 17 and the respective regulation circuits derived from them may also have impacts other than those shown. Hence it is possible, for instance, that both the first measuring instrument 7 and the second measuring instrument 8 would have an impact on both the furnace control as on the control of individual or of all mechanical processing equipment units. Similarly, all conceivable combinations of only partial impact of the measuring instruments and the resulting regulation circuits on only individual devices or on the furnace are conceivable and possible in the framework of the regulating and/or control circuit.

The invention claimed is:

1. A device for controlling or regulating operation of a production line for processing a strap material and comprising:

an annealing or heat treatment furnace (2); and at least one rolling stand (3) and at least one stretching stand (4) arranged one behind the other downstream of the annealing or heat treatment furnace in a strap material processing direction (5), the device comprising:

a regulation or control unit (18) for controlling or regulating the operation of the production line;

two measurement instruments (7, 8, 17) arrangeable at two different positions along the production line for detecting and continuously monitoring at least one and same material property characterizing a mechanical property of the strap material at respective positions, the two measurement instruments being connected with the regulation or control unit (18) for continuously transmitting measured values thereto as data transfer signals, wherein one of the two measurement instruments (7, 8, 17) is arranged immediately in front of or immediately behind the annealing or heat treatment furnace (2) and another of the two measurement instruments is arranged at a different position along the production line; and a feedback control circuit (11, 12, 13) connecting the regulation and control unit with at least the annealing or heat treatment furnace for automatically regulating or controlling operation of the at least the annealing or heat treatment furnace (2) in accordance with the data transfer signals transmitted by the two measurement instruments (7, 8, 17).

2. A device according to claim 1, wherein one of the two measuring instruments (7, 17) is arranged immediately upstream of the annealing or heat treatment furnace (2) in the strap processing direction (5), and another of the two measurement instruments (7, 17) is arranged immediately downstream of the annealing and heat treatment furnace (2), whereby the annealing or heat treatment furnace is controlled in accordance with an influence the annealing or heat treatment furnace exercises on the mechanical material property of the strap material measured by each of the two instruments.

3. A device according to claim 1, wherein one of the two instruments (7, 8) is arranged immediately downstream of the annealing or heat treatment furnace (2) in the strap material processing direction (5), and another of the two measurement instruments (7, 8) is arranged downstream of the stretching stand (4) in the strap material processing directions, and wherein the feedback circuit also connects the regulation and control unit (18) with both the rolling stand (3) and the stretching stand (4) for continuously controlling operation of the annealing or heat treatment furnace (2), the rolling stand (3), and the stretching stand (4) in accordance with data transfer signals transfer signals transmitted by the two measurement instruments (7, 8, 62).

4. A device according to claim 1, wherein the two measurement instruments (7, 8) each detects and monitors the mechanical material property by way of a real-time measurement.

5. A device according to claim 1, wherein the regulation and control unit (18) includes a material model.

6. A device according to claim 1, wherein at least one of the two measurement instruments (7, 8) is a remanence measurement instrument that detects a magnetic value as a measurement value.

7. A device according to claim 1, wherein the regulating and control unit (18) forms part of the production line.

8. A method of controlling or regulating operation of a production line for processing strap material and comprising:

an annealing or heat treatment furnace (2); and at least one rolling stand (3) and at least one stretching stand (4) arranged one behind the other downstream of the annealing or heat treatment furnace in a strap material processing direction (5), the method comprising the steps of:

detecting and continuously monitoring at least one and same material property characterizing a mechanical property of the processed strip material at a location immediately in front of or immediately behind the annealing or heat treatment furnace and at a different location along the production line; and regulating or controlling operation at least of the annealing or heat treatment furnace (2) in accordance with measurement data transmitted from the two locations along the production line, wherein in a framework of a learning process measured values are fed back into the regulating or control circuit in a framework of a closed loop circuit wherein based on a previous behavior of the annealing or heat treatment furnace (2), the regulation or control unit (18) learns reaction of the annealing or heat treatment furnace (2) to different furnace conditions, and adjusts it in order to adjust the measured values for incoming straps.

9. A method according to claim 8, wherein the material property detected at each of the two different locations is transmitted online to a control and regulating unit as data transfer signals.

* * * * *